US008753137B2

(12) United States Patent
Lu

(10) Patent No.: US 8,753,137 B2
(45) Date of Patent: Jun. 17, 2014

(54) COAXIAL CABLE CONNECTOR WITH MULTI-CONTACT TO ENSURE ESTABLISHMENT OF GROUND LOOP

(71) Applicant: Yueh Chiung Lu, Tao Yuan Hsien (TW)

(72) Inventor: Yueh Chiung Lu, Tao Yuan Hsien (TW)

( * ) Notice: Subject to any disclaimer, the term of this patent is extended or adjusted under 35 U.S.C. 154(b) by 94 days.

(21) Appl. No.: 13/621,896

(22) Filed: Sep. 18, 2012

(65) Prior Publication Data

US 2014/0080346 A1 Mar. 20, 2014

(51) Int. Cl.
*H01R 4/28* (2006.01)
*H01R 9/05* (2006.01)

(52) U.S. Cl.
CPC ..... *H01R 9/0521* (2013.01)
USPC ..... 439/322

(58) Field of Classification Search
CPC ..... H01R 2103/00; H01R 9/0521
USPC ..... 439/322, 584
See application file for complete search history.

(56) References Cited

U.S. PATENT DOCUMENTS 6,840,803 B2 * 1/2005 Wlos et al. ..... 439/585
7,008,547 B2 * 3/2006 Chen et al. ..... 216/11
8,328,577 B1 * 12/2012 Lu ..... 439/578

OTHER PUBLICATIONS

U.S. Appl. No. 13/412,972, filed Mar. 6, 2012, Yueh Chiung Lu.
U.S. Appl. No. 13/274,308, filed Oct. 15, 2011, Yueh Chiung Lu.

* cited by examiner

*Primary Examiner* — Phuong Dinh
(74) *Attorney, Agent, or Firm* — Guice Patents PLLC

(57) ABSTRACT

A coaxial cable connector includes a connector body including a barrel, a plastic bushing mounted in the barrel, a body shell inserted into one end of the barrel and abutted against the plastic bushing, an inner tube inserted through the body shell into the barrel defining an end flange and a shoulder, a locknut having an annular groove attached to a neck of the body shell, an inside retaining hole forced into engagement with the shoulder of the inner tube and an abutment surface abutted against the end flange of the inner tube, and an annular contact spring plate set in the inside retaining hole of the locknut with multiple spacer strips thereof clamped on the shoulder of the inner tube to ensure positive establishment of the desired ground loop.

4 Claims, 8 Drawing Sheets

A-A

COAXIAL CABLE CONNECTOR WITH MULTI-CONTACT TO ENSURE ESTABLISHMENT OF GROUND LOOP

BACKGROUND OF THE INVENTION

1. Field of the Invention

The present invention relates to coaxial cable connectors and more particularly, to such a coaxial cable for connecting a coaxial cable to a mating device, which has an annular contact spring plate set in an inside retaining hole of the locknut thereof with multiple spacer strips of the annular contact spring plate clamped on a shoulder of the inner tube thereof to ensure positive establishment of the desired ground loop, enhancing signal transmission stability and reliability.

2. Description of the Related Art

Coaxial cable connectors are commonly designed for assembly with one of a series of coaxial cables having one same specification and different wire outer diameters. Similar designs are seen in U.S. patent application Ser. No. 13/274,308 "Coaxial cable connector" and U.S. patent application Ser. No. 13/412,972, "Coaxial cable connector using a multi-contact spring washer". These two prior art designs commonly discloses the design of an annular groove on the periphery of a neck of a body shell or the inside of a locknut for accommodating an O-ring, and the design of an annular contact spring plate that is mounted on the neck of the body shell and forced into contact with the rear end face of the locknut at multiple contact points to keep an abutment surface of the locknut in close contact with an abutment surface of an inner tube. Thus, a ground loop will be created upon threading of the locknut onto an F-connector of a mating device, ensuring reliable signal transmission.

According to the aforesaid two prior art designs, the annular contact spring plate is mounted on the neck of the body shell and kept in contact with the rear end face of the locknut to force the abutment surface of the locknut against the abutment surface of the inner tube. When threading the locknut onto the F-connector of the mating device, much resisting force will be produced, i.e., the installer shall employ much effort to finish the installation.

FIG. 1 illustrates another prior art design of coaxial cable connector 91 for connecting a coaxial cable 90 to a mating device 92 (see FIG. 2). The coaxial cable connector 91 comprises a locknut 93 having an inner thread 94 for threading onto an outer thread 96 of an F-connector 95 of the mating device 92.

During installation, the central conductor 97 of the coaxial cable 90 is inserted into a conducting clamp 98 to achieve signal conduction. Further, the end flange 902 of the inner tube 99 of the coaxial cable connector 91 can be kept in positive contact with the end face 903 of the F-connector 95 of the mating device 92 to ensure conduction between the braided outer conductor 901 of the coaxial cable 90 and the metal casing of the F-connector 95 for grounding only after the inner thread 94 of the locknut 93 has been tightly threaded onto the outer thread 96 of the F-connector 95.

According to the aforesaid prior art design, it is difficult to keep the end flange 902 of the inner tube 99 of the coaxial cable connector 91 in positive contact with the end face 903 of the F-connector 95 of the mating device 92. Further, the connection between the inner thread 94 of the locknut 93 and the outer thread 96 of the F-connector 95 of the mating device 92 may be loosened after a long use. Therefore, it is desirable to provide a coaxial cable connector that can positively create the desired ground loop, ensuring reliable signal transmission.

SUMMARY OF THE INVENTION

The present invention has been accomplished under the circumstances in view. It is main object of the present invention to provide a coaxial cable connector for connecting a coaxial cable to a mating device, which creates an optimal ground loop positively, ensuring reliable and optimal signal transmission.

To achieve this and other objects of the present invention, a coaxial cable connector comprises a connector body connected to one end of a coaxial cable, a locknut for locking the connector body to a mating device, and an annular contact spring plate set between the connector body and the locknut. The connector body comprises a barrel, a plastic bushing mounted in the barrel, a body shell inserted into one end of the barrel and abutted against the plastic bushing, the body shell comprising an axial hole and a neck located on one end thereof around the axial hole, an inner tube inserted through the axial hole of the body shell into the inside of the barrel, the inner tube comprising an end flange radially extended around the periphery of one end thereof, an abutment surface located on an inner side of the end flange and a shoulder located on the periphery thereof near the abutment surface of the inner tube and kept in contact with the neck of the body shell. The locknut is attached to one end of the inner tube and one end of the body shell, comprising an annular groove attached to the neck of the body shell, an inside retaining hole forced into engagement with the shoulder of the inner tube, and an abutment surface connected to one end of the inside retaining hole and abutted against the abutment surface of the inner tube. The annular contact spring plate is set between the shoulder of the inner tube and the inside retaining hole of the locknut, comprising an annular body having a predetermined axial width and positioned in the inside retaining hole of the locknut and a plurality of spacer strips extended from the annular body thereof and clamped on the shoulder of the inner tube. The spacer strips define a relatively larger radial thickness than the thickness of the annular body.

Further, the spacer strips of the annular contact spring plate extend obliquely from the annular body of the annular contact spring plate toward the central axis of the coaxial cable connector.

Further, an O-ring is set between the neck of the body shell and the annular groove of the locknut.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
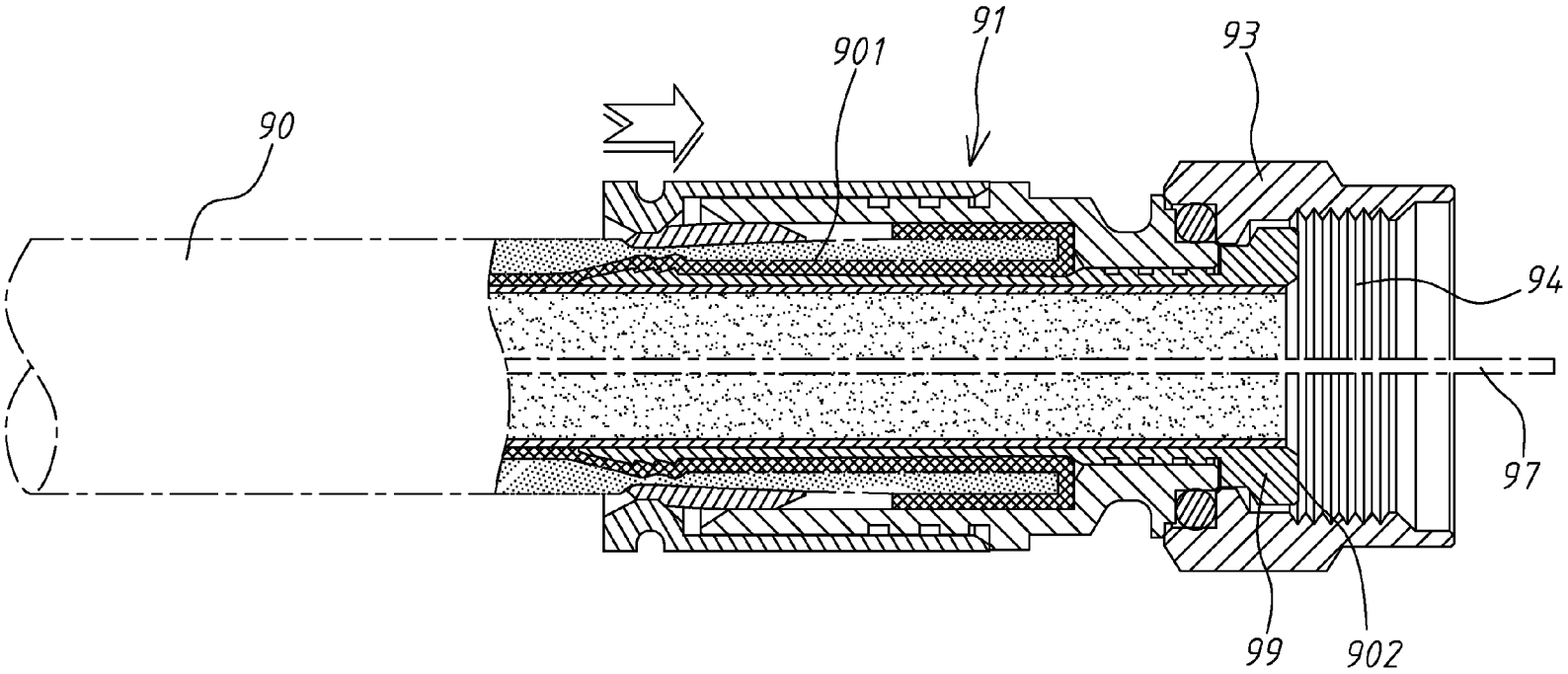
FIG. 1 (Prior Art)
FIG. 1 is a sectional view of a coaxial cable connector according to the prior art.
Figure 2:
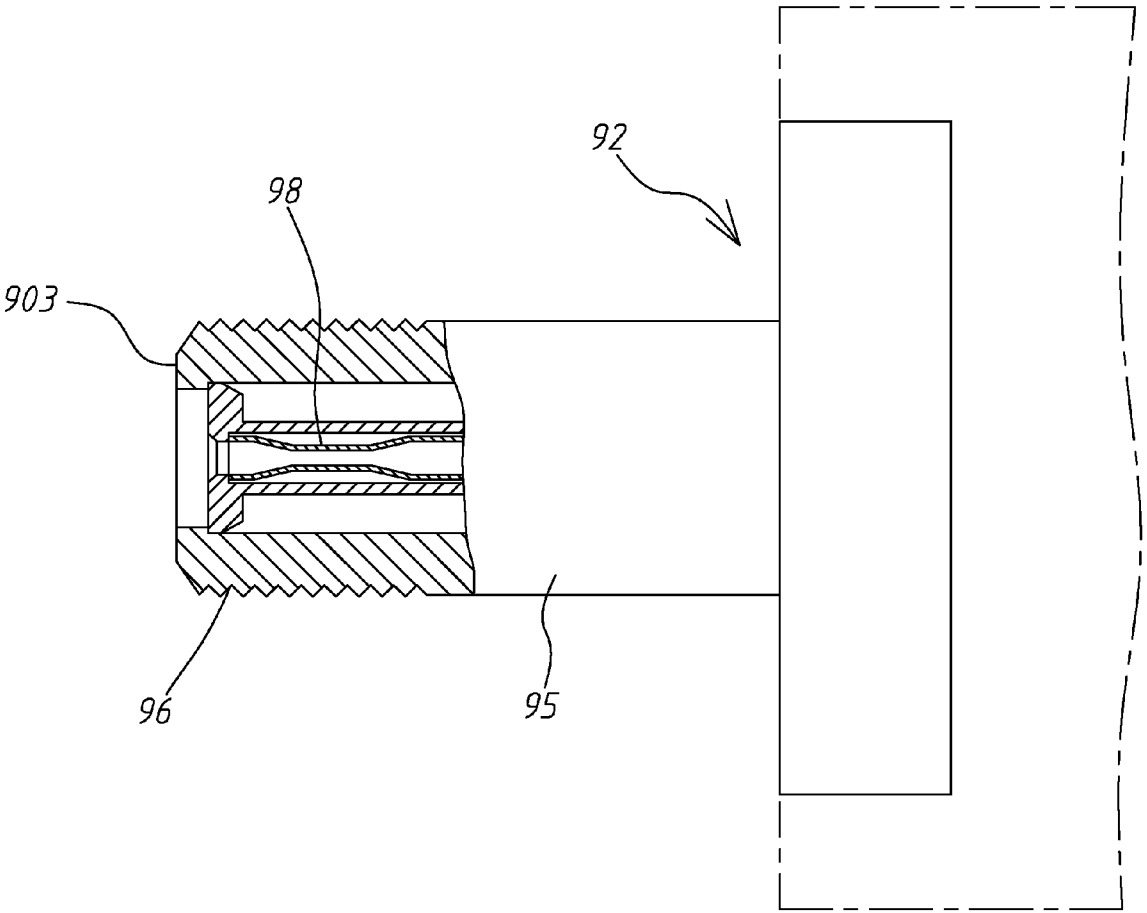
FIG. 2 (Prior Art)
FIG. 2 is a schematic sectional view illustrating the prior art coaxial cable connector installed in a mating device.
Figure 3:
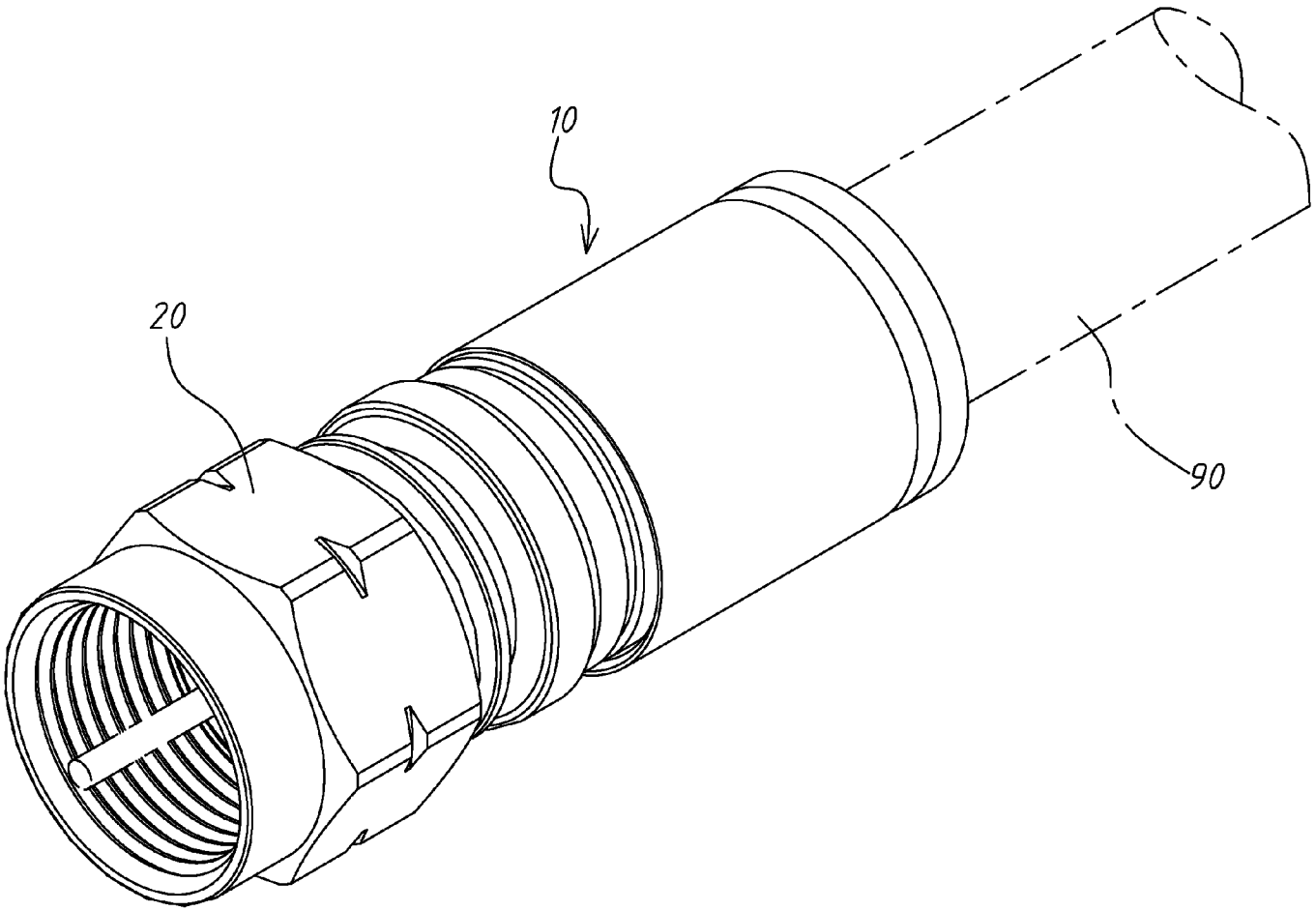
FIG. 3 is an elevational view of a coaxial cable connector in accordance with the present invention.

Referring to FIG. 3, a coaxial cable connector in accordance with the present invention is shown comprising a connector body 10 connectable to one end of a coaxial cable 90, an O-ring 70 mounted in the connector body 10, a locknut 20 for locking the connector body 10 to a mating device 92 (see FIG. 2), and an annular contact spring plate 80 set between the connector body 10 and the locknut 20.

Referring to FIGS. 4, 4A, 5 and 5A, the connector body 10 comprises a barrel 30, a plastic bushing 40 mounted in the barrel 30, a body shell 50, which is inserted into one end of the barrel 30 and abutted against the plastic bushing 40 and which defines an axial hole 52 and a neck 51 located on one end thereof around the axial hole 52, an inner tube 60 which is inserted through the axial hole 52 of the body shell 50 into the inside of the barrel 30 and which comprises an end flange 62 radially extended around the periphery of one end thereof, an abutment surface 63 located on an inner side of the end flange 62 and a shoulder 61 located on the periphery near the abutment surface 63 and kept in contact with the neck 52 of the body shell 50.

The locknut 20 is attached to one end of the inner tube 60 and one end of the body shell 50, comprising an annular groove 21 attached to the neck 51 of the body shell 50, an inside retaining hole 22 forced into engagement with the shoulder 61 of the inner tube 60, and an abutment surface 23 connected to one end of the inside retaining hole 22 and abutted against the abutment surface 63 of the inner tube 60.

The O-ring 70 is set between the neck 51 of the body shell 50 and the annular groove 21 of the locknut 20.

The annular contact spring plate 80 is set between the shoulder 61 of the inner tube 60 and the inside retaining hole 22 of the locknut 20.

Figures 4, 4A:
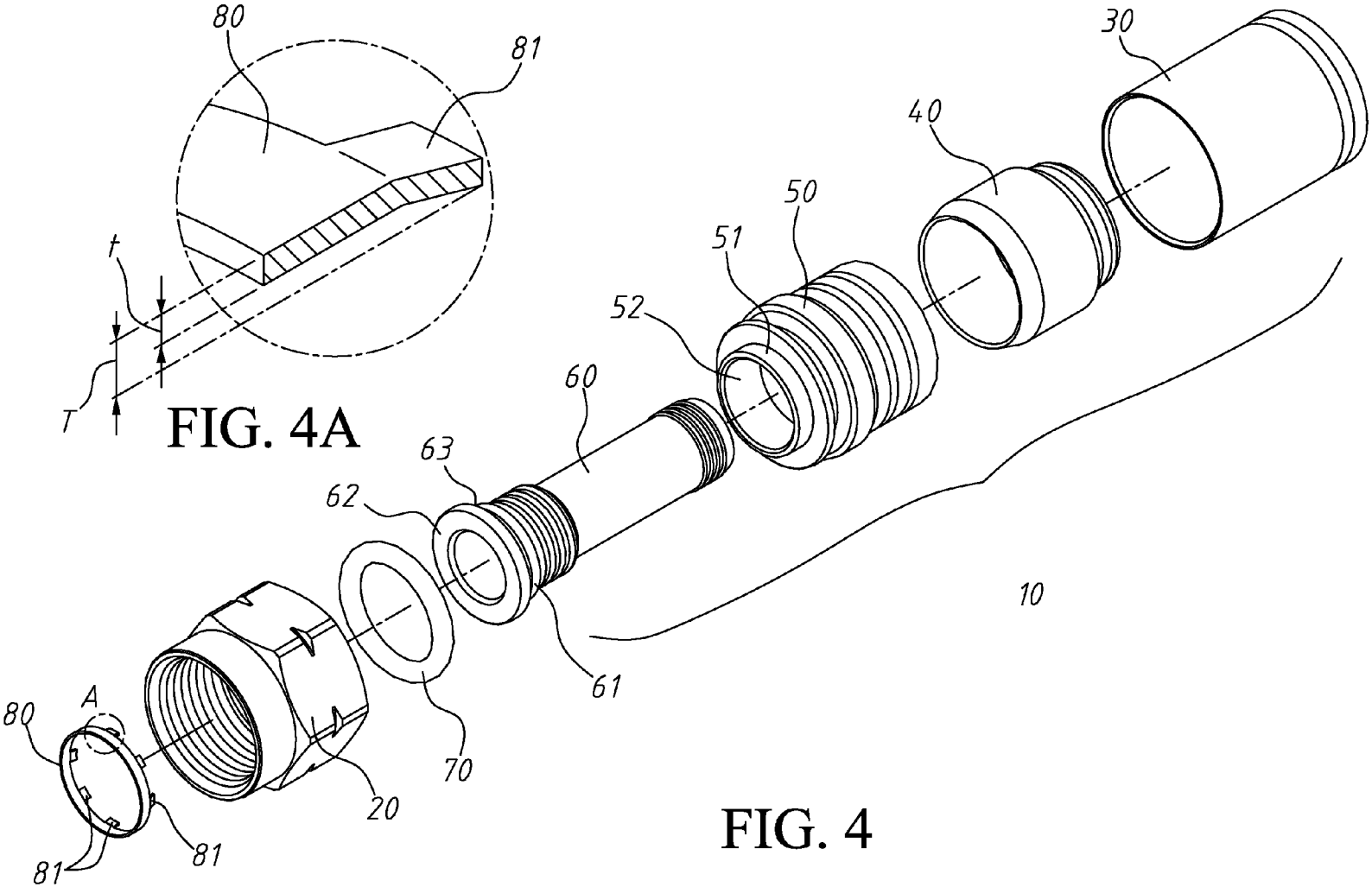
FIG. 4 is an exploded view of the coaxial cable connector shown in FIG. 3.
FIG. 4A is an enlarged view of Part A of FIG. 4, illustrating the structure of the annular contact spring plate in the locknut.

In this embodiment, the annular contact spring plate 80 is fitted into the inside retaining hole 22 of the locknut 20, comprising a plurality of equiangularly spaced spacer strips 81. These spacer ribs 81 are not arranged on the same horizontal direction relative to the annular body of the annular contact spring plate 80, as shown in FIG. 4A, thereby defining a relatively larger radial thickness T than the thickness t of the annular body of the annular contact spring plate 80. Thus, the spacer strips 81 extend obliquely toward the central axis of the coaxial cable connector (i.e., toward the center conductor 97 of the coaxial cable 90).

Figure 5A:
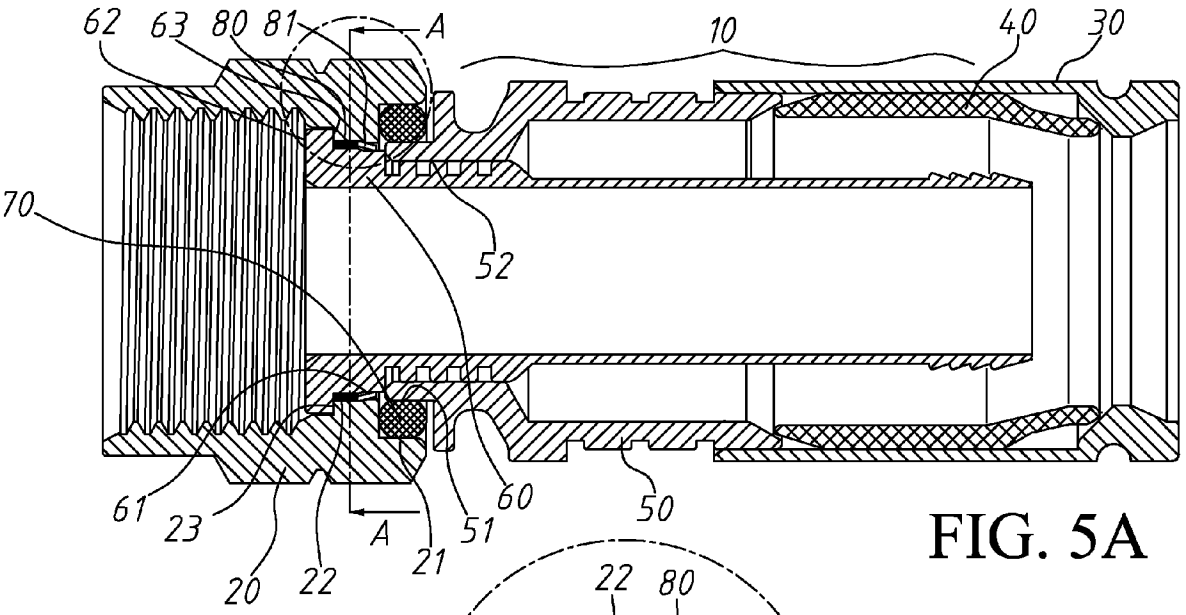
FIG. 5A is an enlarged view of a part of FIG. 5, illustrating the connection structure between the locknut and the inner tube.
Figure 5:
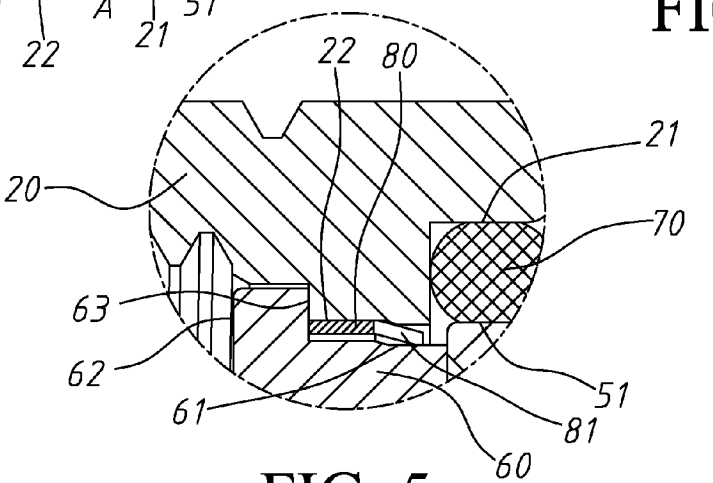
FIG. 5 is a longitudinal sectional view of the coaxial cable connector in accordance with the present invention before installation of a coaxial cable.
Figure 6:
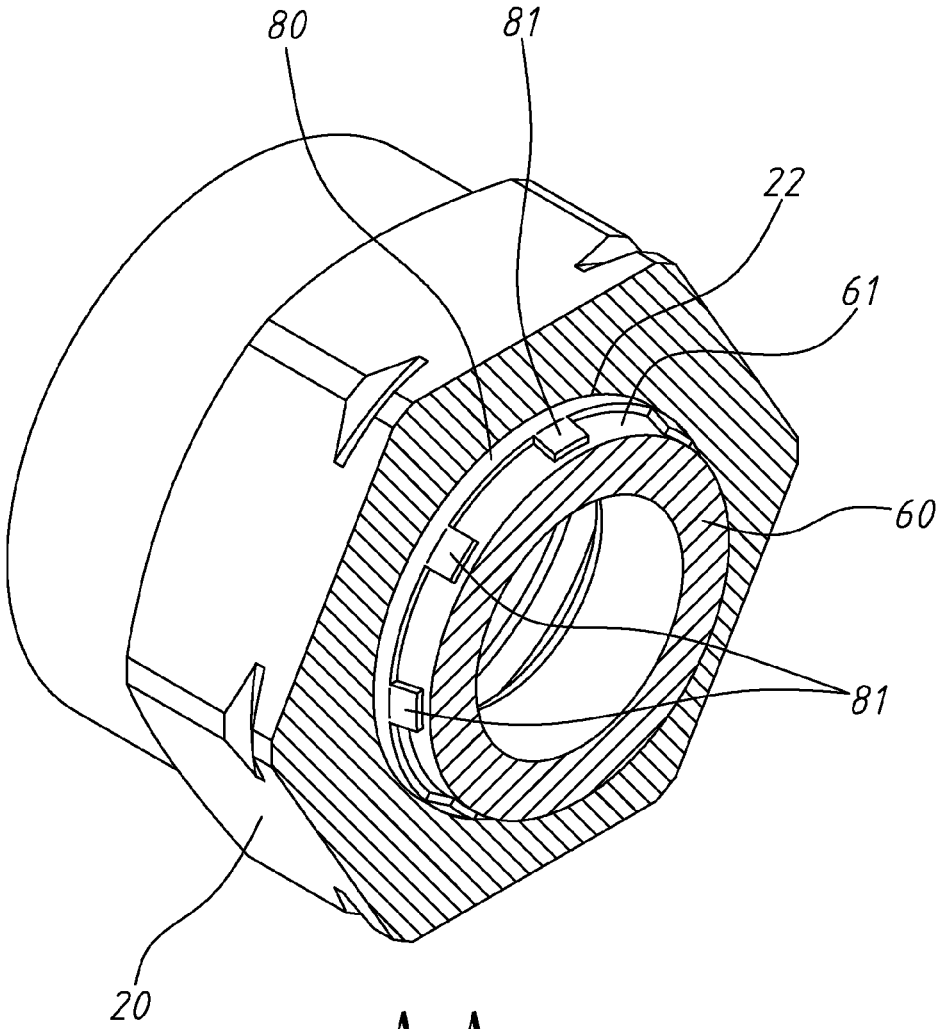
FIG. 6 is a sectional elevational view taken along line A-A of FIG. 5.

Referring to FIGS. 5 and 6, the annular contact spring plate 80 fits the inside retaining hole 22 of the locknut 20 and is positioned with its relatively larger radial thickness T in between the inside retaining hole 22 of the locknut 20 and the shoulder 61 of the inner tube 60 to have the spacer strips 81 be elastically held down on the shoulder 61 of the inner tube 60.

Figure 7:
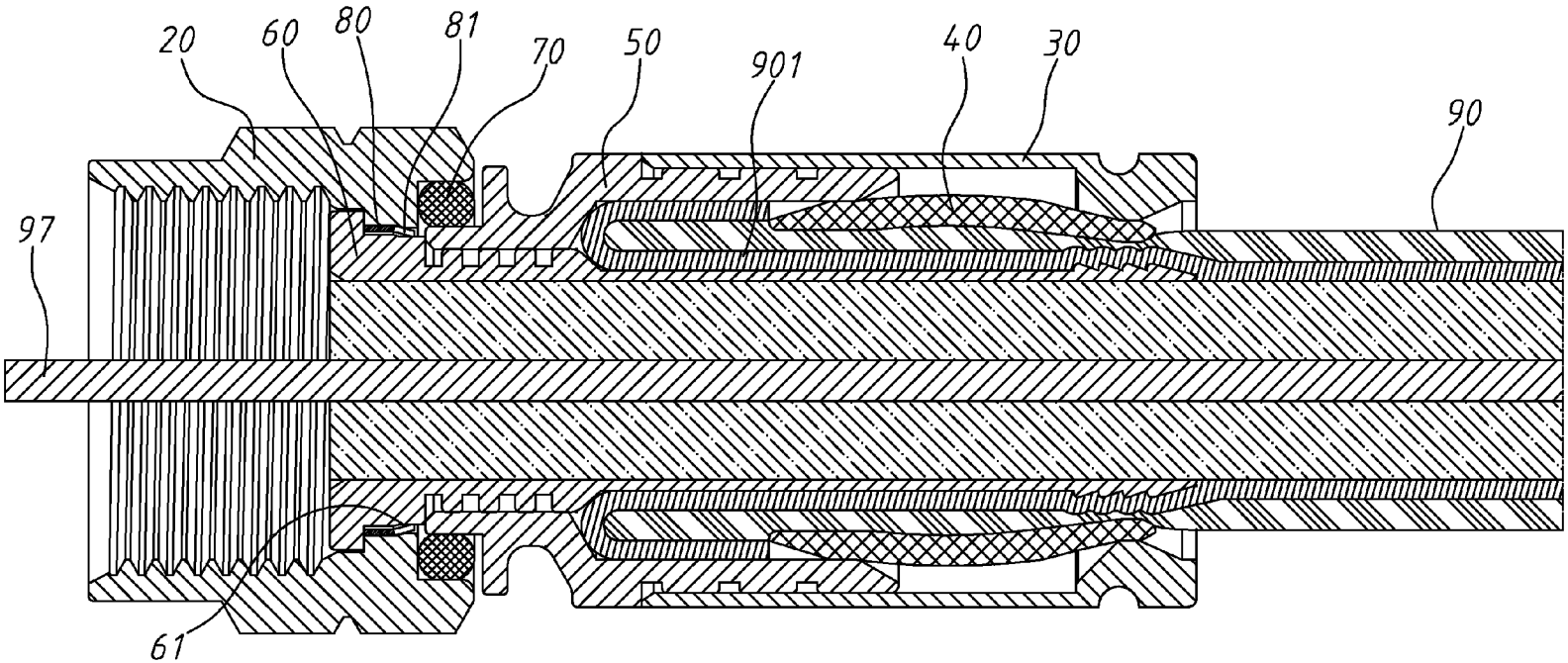
FIG. 7 corresponds to FIG. 5, illustrating a coaxial cable connected to the coaxial cable connector.

Referring to FIG. 7, after connection between the coaxial cable connector and the coaxial cable 90, the barrel 30 is pressed on the body shell 50, the locknut 20 holds down the annular contact spring plate 80, the spacer strips 81 of the annular contact spring plate 80 are elastically held down on the shoulder 61 of the inner tube 60, and the inner tube 60 surrounds the braided outer conductor 901 of the coaxial cable 90, and therefore, the locknut 20, the annular contact spring plate 80, the inner tube 60 the braided outer conductor 901 of the coaxial cable 90 establish a ground loop.

Figure 8:
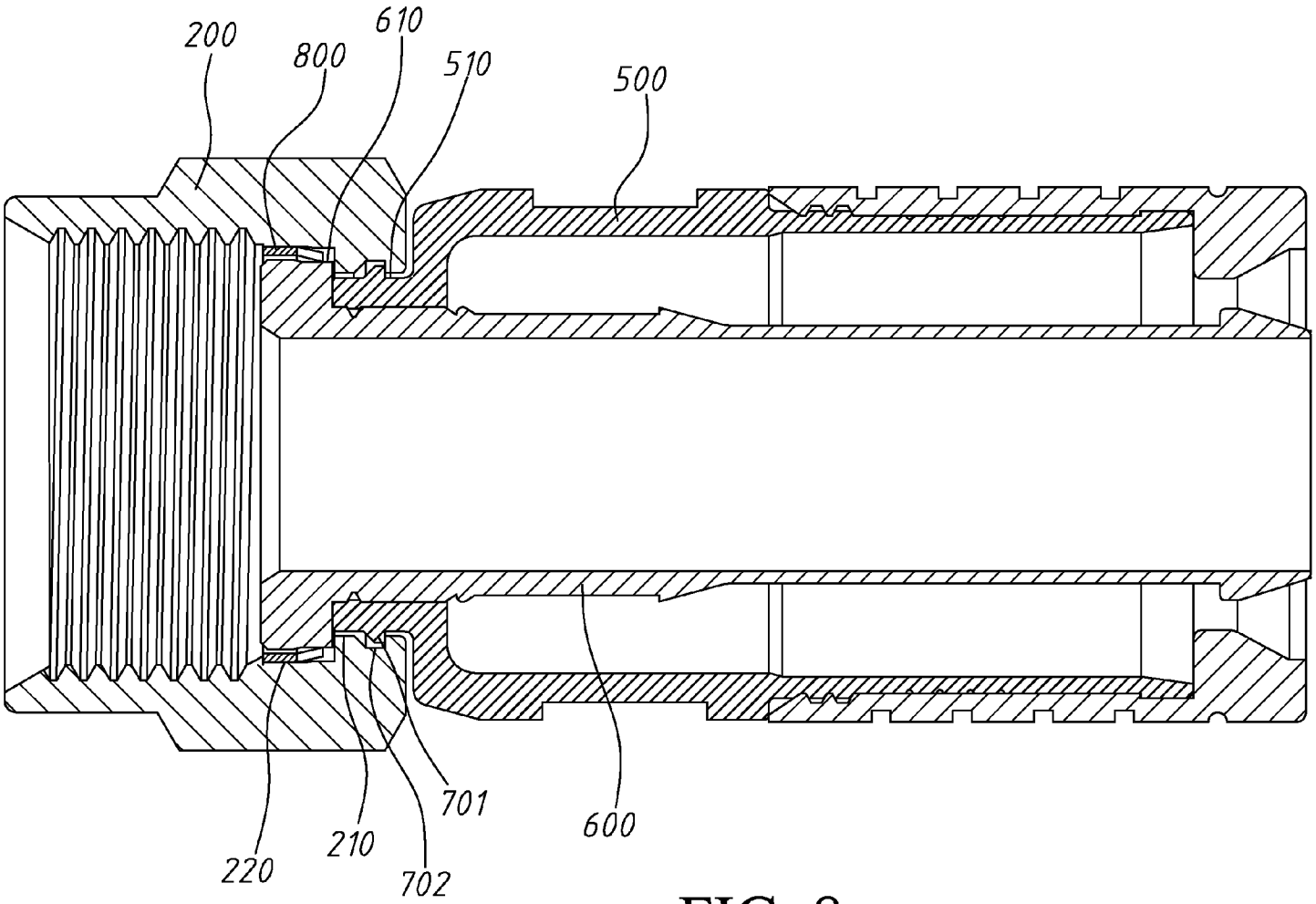
FIG. 8 is a sectional view of an alternate form of the coaxial cable connector in accordance with the present invention.

FIG. 8 illustrates an alternate form of the coaxial cable connector in accordance with the present invention. This alternate form is substantially similar to the aforesaid embodiment shown in FIGS. 3-7 with the exception of the following features. The body shell 500 comprises a neck 510; the locknut 200 comprises an inner shoulder 210 fitting the neck 510 of the body shell 500, an inside retaining hole 220 fitting the shoulder 610 of the inner tube 600; the annular contact spring plate 800 that is set between the inside retaining hole 220 of the locknut 200 and the shoulder 610 of the inner tube 600 has its annular body of a predetermined axial width positioned in the inside retaining hole 220 of the locknut 200; the locknut 200 and the body shell 500 are coupled together by means of engagement between a recessed portion 701 at the body shell 500 and a raised portion 701 at the locknut 200.

Subject to the arrangement of the annular contact spring plate 80 between the locknut 20 and the inner tube 60 to have the spacer strips 81 be elastically held down on the shoulder 61 of the inner tube 60, multiple contact points are positively established between the locknut 20 and the inner tube 60 to conduct the locknut 20 and the inner tube 60, forming the desired group loop. Thus, the locknut 20 of the coaxial connector in accordance with the present invention can be easily and smoothly threaded onto the outer thread 96 of the F-connector 95 of the mating device 92. Even the locknut 20 is not tightly fastened to the F-connector 95 of the mating device 92, an optimal ground loop can still be established, ensuring reliable and optimal signal transmission. Further, the coaxial connector in accordance with the present invention has the characteristic of high durability.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A coaxial cable connector, comprising a connector body connected to one end of a coaxial cable, a locknut for locking said connector body to a mating device, and an annular contact spring plate set between said connector body and said locknut, wherein:

said connector body comprises a barrel, a plastic bushing mounted in said barrel, a body shell inserted into one end of said barrel and abutted against said plastic bushing, said body shell comprising an axial hole and a neck located on one end thereof around said axial hole, an inner tube inserted through said axial hole of said body shell into the inside of said barrel, said inner tube comprising an end flange radially extended around the periphery of one end thereof, an abutment surface located on an inner side of said end flange and a shoulder located on the periphery thereof near the abutment surface of said inner tube and kept in contact with said neck of said body shell;

said locknut is attached to one end of said inner tube and one end of said body shell, comprising an annular groove attached to the neck of said body shell, an inside retaining hole forced into engagement with said shoulder of said inner tube, and an abutment surface connected to one end of said inside retaining hole and abutted against the abutment surface of said inner tube;

said annular contact spring plate is set between the shoulder of said inner tube and said inside retaining hole of said locknut, comprising an annular body having a predetermined axial width and positioned in said inside retaining hole of said locknut and a plurality of spacer strips extended from said annular body thereof and clamped on the shoulder of said inner tube, said spacer strips defining a relatively larger radial thickness than the thickness of said annular body.

2. The coaxial cable connector as claimed in claim 1, wherein said spacer strips of said annular contact spring plate extend obliquely from said annular body of said annular contact spring plate toward the central axis of the coaxial cable connector.

3. The coaxial cable connector as claimed in claim 1, further comprising an O-ring set between the neck of said body shell and the annular groove of said locknut.

4. The coaxial cable connector as claimed in claim 1, wherein said locknut and said body shell are coupled together by means of engagement between a recessed portion at one of said body shell and said body shell and a raised portion at the other of said locknut and said body shell.

* * * * *